United States Patent [19]

Leupold et al.

[11] Patent Number: 4,592,889

[45] Date of Patent: Jun. 3, 1986

[54] METHOD AND APPARATUS FOR THE PRESSING AND ALIGNMENT OF RADIALLY ORIENTED TOROIDAL MAGNETS

[75] Inventors: Herbert A. Leupold, Eatontown; Ernest Potenziani, II, Ocean; Joseph P. Klimek, South Amboy; Arthur Tauber, Elberon, all of N.J.

[73] Assignee: The United States of America as represented by the Secretary of the Army, Washington, D.C.

[21] Appl. No.: 714,602

[22] Filed: Mar. 21, 1985

[51] Int. Cl.[4] ..... B22F 5/00

[52] U.S. Cl. ..... 419/66; 419/38; 419/49; 29/607; 100/3; 148/108; 266/249

[58] Field of Search ..... 148/108; 419/66, 38, 419/49; 29/607; 266/249; 100/3

[56] References Cited

U.S. PATENT DOCUMENTS

| | | | |
|---|---|---|---|
| 3,244,782 | 4/1966 | Eyberger | 419/66 |
| 3,969,456 | 7/1976 | Graf et al. | 419/66 |
| 4,104,782 | 8/1978 | Veeck et al. | 419/49 |
| 4,197,146 | 4/1980 | Frischmann | 419/23 |
| 4,390,488 | 6/1983 | Wessel | 419/66 |

*Primary Examiner*—Stephen J. Lechert, Jr.
*Attorney, Agent, or Firm*—Anthony T. Lane; Jeremiah G. Murray; Paul A. Fattibene

[57] ABSTRACT

A method and apparatus for pressing magnetic powder in a toroidal-shape while in a radial magnetic field. A magnetic flux is produced and carried by a die rod through the axial center of toroidally-shaped magnetic powder. An annular portion coaxially surrounding the die rod and magnetic powder is connected to a yoke member which carries the magnetic flux back to the magnetic flux producing means. This completes the magnetic circuit, and creates a radial magnetic field across the toroidally-shaped magnetic powder between the die rod and the annular portion. This radial magnetic field aligns the granules of the toroidally shaped magnetic powder during pressing.

9 Claims, 4 Drawing Figures

METHOD AND APPARATUS FOR THE PRESSING AND ALIGNMENT OF RADIALLY ORIENTED TOROIDAL MAGNETS

The invention described herein may be manufactured, used and licensed by or for the Government for governmental purposes without the payment to use of any royalties thereon.

BACKGROUND OF THE INVENTION

1. Field of the Invention

This invention relates generally to the pressing and alignment of radially-oriented toroidal magnets and more specifically to a method and apparatus for pressing and aligning magnetic powders into a radially-oriented unitary toroidal shape.

2. Description of the Prior Art

Radially-oriented toroidal magnets are well known in the permanent magnet art. Their use has been limited, however, because of the difficulties encountered in fabricating them and because they lacked the ability to provide sufficiently high magnetic coercivities and remanences for certain applications. Radially-oriented toroidal magnets are usually fabricated by joining discrete annular sections which are individually magnetized in a straight rather than in a radial magnetic field. The annular sections are then bonded together to form a toroidally-shaped magnet. However, because of the straight magnetic field employed during manufacture the radial field of the magnet is not a true radially-aligned field, but a synthesized radial magnetic field. For some applications this is satisfactory but for other applications the synthesized field does not produce the desired high magnetic field strength because of the non-radial alignment of the field.

In applications involving relatively small radially-oriented toroidal permanent magnets the bonding of sections to form a toroid is not practical due to their small size. There exists no known method or apparatus for the pressing and aligning of small unitary toroidally-shaped pressed magnetic material.

An example where small, radially-oriented toroidal permanent magnets are needed is in millimeter-wave applications, such as travelling wave tubes, particle accelerators, and travelling wave tube amplifiers, for example. The need for improving the magnetic intensity per unit weight of such magnets to thereby improve the overall size and cost of the magnet has long been recognized.

BRIEF SUMMARY OF THE INVENTION

It is an object of this invention to provide a method and apparatus for pressing and aligning radially-orientated toroidal permanent magnets having materially improved magnetic field strengths.

It is a further object of this invention to provide a method and apparatus for producing toroidal permanent magnets having truly radially-aligned magnetic fields.

It is a still further object of this invention to provide a method and apparatus for pressing and aligning radially-oriented toroidal permanent magnets which is particularly suited for the manufacture of toroidal magnets having a central bore opening of relatively small size.

It is an additional object of this invention to provide a method and apparatus for producing radially-oriented toroidal permanent magnets wherein the pressing and magnetic alignment of the magnetic powder is accomplished in a single step.

It is an additional object of this invention to provide a method for producing radially-oriented toroidally-shaped pressed magnetic powders, which method comprises a minimum number of steps and is easily performed.

Briefly, the pressing and alignment apparatus of the invention comprises, magnetic flux producing means; magnetic circuit means coupled to said magnetic flux producing means and defining a closed magnetic circuit therewith, said magnetic circuit means having a first portion defining a substantially cylindrical-shaped cavity, and a second portion disposed in said cavity to create a substantially toroidal-shaped cavity through which the flux in said magnetic circuit passes in radially-aligned paths and which is adapted to receive the magnetic material therein; and means, disposed in said substantially cylindrical cavity, for compressing the magnetic material therein.

DETAILED DESCRIPTION OF THE PREFERRED EMBODIMENT

Figure 1:
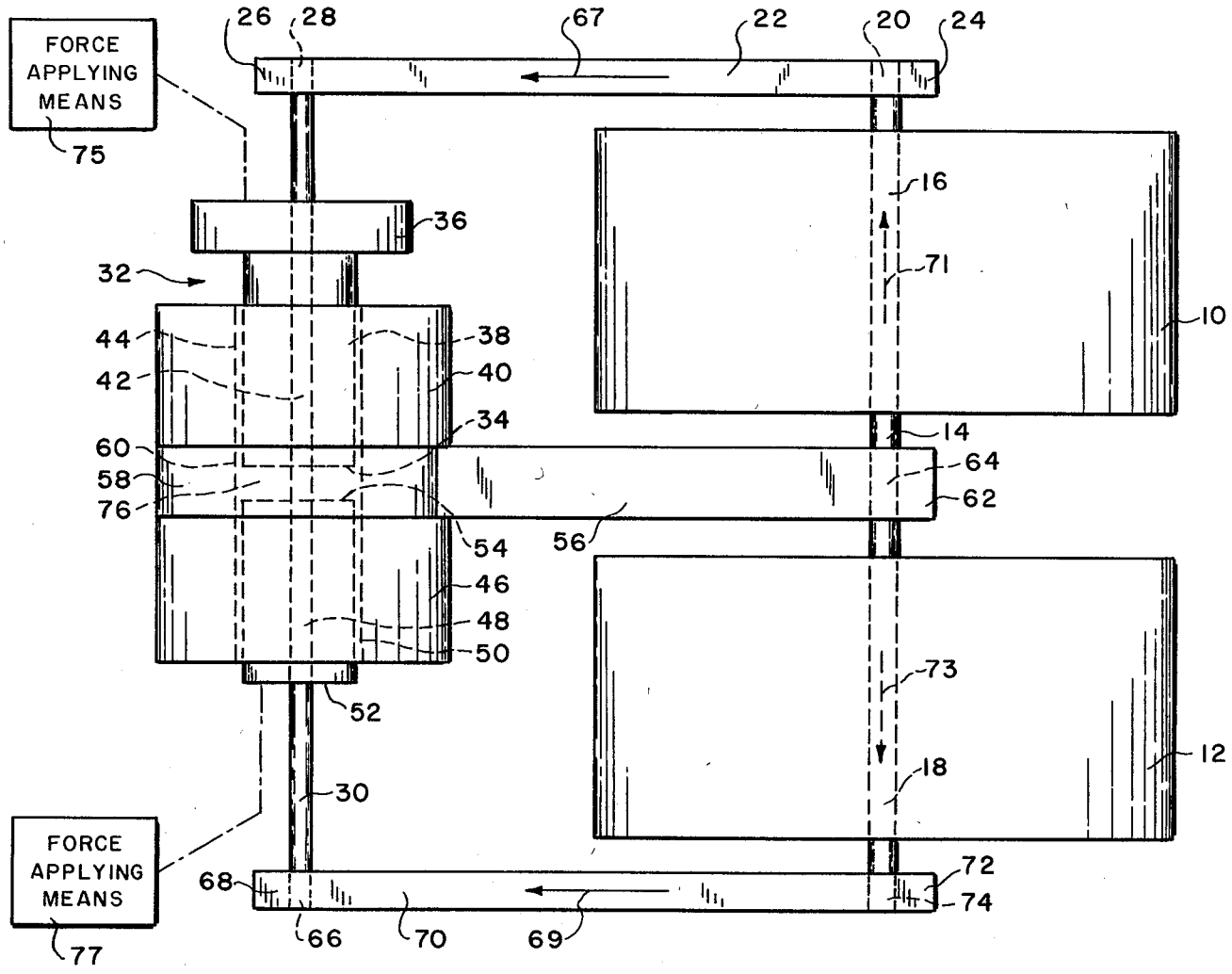
FIG. 1 is a front elevation view of the preferred embodiment of the apparatus of the invention wherein the magnetic flux producing means and force applying means are shown schematically.

In FIG. 1 a first magnetic flux producing means or solenoid indicated generally as 10, is concentrically positioned around an upper section 16 of a cylindrical solenoid rod indicated generally as 14. A second magnetic flux producing means or solenoid indicated generally as 12, is concentrically positioned around another section 18 of cylindrical solenoid rod 14. Solenoid rod 14 is made of a high permeability, high saturation field magnetic flux carrying material. Solenoid rod 14 has one end 20 thereof which is seated in an opening in one end 24 of a first arm indicated generally as 22. This connection provides a good surface contact and a low reluctance path between the magnetically coupled first arm 22 and solenoid rod 14. Arm 22 is also made of a high permeability, high saturation field magnetic flux carrying material. Arm 22 extends generally perpendicular to solenoid rod 14. The other end 26 of arm 22 is similarly magnetically coupled to end 28 of a cylindrical die rod indicated generally as 30. A cylindrical punch indicated generally as 32 and having an enlarged shoulder or head portion 36 is concentrically and slidably mounted on cylindrical die rod 30. Punch 32 maybe made of a nonmagnetic stainless steel. The end face 34 of reduced diameter portion 38 of punch 32 extends into a first die body indicated generally as 40, and is thinly clad with a layer of tungsten carbide for durability. The first die body 40 is concentrically disposed about section 42 of cylindrical die rod 30. Die body 40 has a coaxial bore 44 of sufficient diameter to permit the reduced diameter portion 38 of cylindrical punch 32 to be slidably disposed therein. The surface of bore 44 of the die body 40 is lined with tungsten carbide to minimize die wear and produce a minimum of "dead" material. "Dead" material being that material having a reduced flow rate during pressing near the surface of bore 44 of the die body 40. Die body 40 may also be made of a nonmagnetic stainless steel.

Below die body 40 a second cylindrical die body indicated generally as 46, is concentrically positioned around another section 48 of die rod 30. Second die body 46 has a coaxial bore 50 of the same diameter as the bore 44 in first die body 40. Second die body 46 may also be made of a nonmagnetic stainless steel, and lined with tungsten carbide to ensure good die durability and a minimum of dead material. A cylindrical anvil indicated generally as 52 is concentrically and slidably mounted on a section 48 of die rod 30 below punch 32. Anvil 52 may be made of a nonmagnetic stainless steel. The end face 54 of anvil 52 that extends into die body 46 is thinly clad with tungsten carbide for durability. Anvil 52 has a diameter suitable to permit it to slidably extend within the bore 50 of second die body 46. Between first die body 40 and second die body 46 is positioned a yoke member indicated generally as 56. Yoke member 56 has an annular portion 58 on one end thereof with a cylindrical bore 60 extending therethrough. The bore 60 is disposed concentrically about die rod 30. The other end 62 of yoke member 56 , is magnetically coupled to a section 64 of solenoid rod 14 which lies between first solenoid 10 and second solenoid 12. The other end 66 of die rod 30 is magnetically coupled and demountably attached to one end 68 of a second arm indicated generally as 70. Second arm 70 is made of a high permeability, high saturation field magnetic flux carrying material. Second arm 70 extends substantially perpendicular to die rod 30 and is substantially parallel to first arm 22. The other end 72 of second arm 70, is magnetically coupled and demountably attached to the other end 74 of solenoid rod 14 below second solenoid 12.

Figure 2:
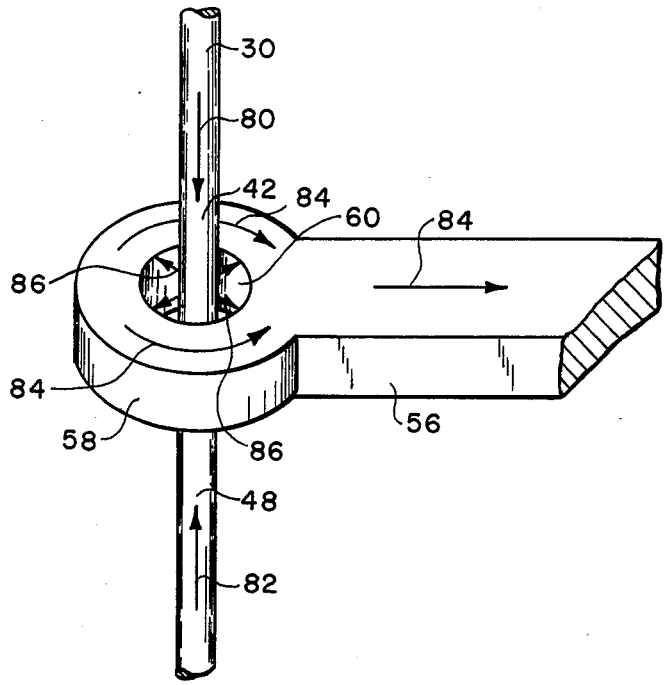
FIG. 2 is a perspective view of a portion of the apparatus of the invention showing in detail how the radially-oriented magnetic field is created.

The end portion 58 of yoke member 56 is shown in detail in FIG. 2 wherein punch 32, first die body 40, second die body 46, and anvil 52 have been eliminated for clarity of illustration. As seen in FIG. 2, cylindrical die rod 30 extends coaxially through cylindrical bore 60 in portion 58 of yoke member 56. An arrow 80 on the upper section 42 of die rod 30 represents the direction of magnetic flux being carried by this section of die rod 30. The magnetic flux represented by arrow 80 is generated or produced by solenoid 10 shown in FIG. 1. Arrow 82 on the lower section 48 of die rod 30 represents the direction of magnetic flux being carried by this section of die rod 30. The magnetic flux represented by arrow 82 is generated or produced by solenoid 12 shown in FIG. 1. Arrows 84 on yoke member 56 represent the direction of magnetic flux being carried by the yoke member 56 back to the magnetic flux generating source or solenoids 10 and 12 shown in FIG. 1, to complete the magnetic circuit. Arrows 86 within cylindrical bore 60 represent the radial magnetic field generated by the flux carried in die rod 30 and yoke member 56.

Referring to FIGS. 1 and 2 the device is operated by first removing arm 22 from die rod 30. Punch 32 is then removed from first die body 40. Magnetic powder, typically a samarium cobalt compound, is then placed within the toroidally-shaped cavity 76, which is defined by the bore 60 yoke member 56, the end face 34 of punch 32, the end face 54 of anvil 52, and the die rod 30. Punch 32 is then replaced within the cylindrical bore 44 of first die body 40. Arm 22 is also replaced on die rod 30. Solenoids 10 and 12 are then energized to create a magnetic flux within solenoid rod 14. Solenoid 10 is wound so that a magnetic flux is created in a direction represented by arrow 71 on solenoid rod 14. Solenoid 12 has a winding in the opposite direction as that of solenoid 10 so that a magnetic flux is created having a direction represented by arrow 73 on solenoid rod 14. The magnetic flux genreated by solenoid 10 and represented by arrow 71 is in the opposite direction as the magnetic flux generated by solenoid 12 and represented by arrow 73. The magnetic flux generated by solenoid 10 is carried by arm 22 in a direction represented by arrow 67 to die rod 30. Similarly the magnetic flux generated by solenoid 12 is carried from solenoid rod 14 to arm 70. Arrow 69 represents the direction of magnetic flux carried by arm 70 to die rod 30. The magnetic flux from arm 70 is then carried along die rod 30 into cavity 76. At the other end 28 of die rod 30 magnetic flux from arm 22 and represented by arrow 67 is carried from the end 28 of die rod 30 into cavity 76. The magnetic flux, being located at the center of the toroidally-shaped magnetic powder, radiates outward to the annular portion 58 of yoke member 56 creating a radial magnetic field 86 in toroidally-shaped cavity 76. The magnetic flux carried by yoke member 56 and represented by arrows 84 is returned to the solenoid rod 14 at portion 64 between solenoids 10 and 12. This completes the magnetic circuit. The resulting magnetic field created in cavity 76 aligns the easy axes of the magnetic powder granules. A force applying means indicated schematically by box 75, and attached to punch 32 together with a force applying means indicated schematically by box 77, and attached to anvil 52 are used to press the magnetic powder in cavity 76. The force applying means can be any force applying means such as a hydraulic, mechanical, or electro-mechanical pressing means. After pressing the magnetic field can be removed. The aligned toroidally-shaped pressed magnetic powder is removed from the annular portion 58 of yoke member 56, and die bodies 40 and 46. This can be accomplished by removing arm 70, and slidably removing anvil 52 from the cylindrical bore 50 of die body 46. Punch 32 can now be used to push the aligned toroidally-shaped pressed magnetic powder out of bore 60 of yoke member 56 and bore 50 of die body 46. The aligned and pressed toroidally-shaped magnetic powder can now be processed by conventional densification techniques such as sintering or hot isostatic pressing.

Referring to FIG. 2 the radial magnetic field represented by arrows 86 can more easily be seen. The magnetic flux generated by solenoid 10, of FIG. 1, and represented by arrow 80 is carried by die rod 30 into bore 60. The magnetic flux, represented by arrow 82 and generated by solenoid 12, of FIG. 1, is carried to the bore 60 from the opposite direction as the flux represented by arrow 80. The combined magnetic flux from solenoids 10 and 12 of FIG. 1, after entering bore 60 is carried to the annular portion 58 of yoke member 56 surrounding bore 60.

The greater the magnetic flux density carried into the bore 60 the larger the radial magnetic field 86 will be. The magnetic flux carrying capability of die rod 30 is limited. The amount of flux carried by die rod 30 cannot exceed the product of the saturation flux density of the material from which die rod 30 is made, and its lateral cross sectional area.

In applications involving small diameter toroidal magnets the correspondingly small diameter of die rod 30 prohibits large amounts of magnetic flux from entering the bore 60. Therefore, magnetic flux leakage through various permeance paths outside the radial magnetic field 86 should be minimized. A permeance path exist between die rod 30 and the annular portion 58 of yoke member 56 surrounding bore 60. For this reason, the annular portion 58 of yoke member 56 should not be made too wide in the radial direction. But the annular portion 58 of yoke member 56 should be at least as radially wide as the radial thickness of the toroidal magnetic powder. This is to provide a uniform radial magnetic field within bore 60.

The magnetic flux carried by die rod 30 and entering bore 60 should be of sufficient magnitude to provide a saturation magnetic flux density in the magnetic powder at the outer perimeter of the toroidally-shaped magnetic powder placed within cavity 76 of FIG. 1. This is to provide maximum alignment of the magnetic material.

In small diameter toroidally-shaped magnets it is usually necessary to cause magnetic flux to enter cavity 76 from two directions to create the required saturation magnetic flux density at the outer perimeter of the toroidally-shaped magnetic powder. This is due to the limited flux carrying capability of the small diameter die rod 30. In applications where the diameter of the toroidally-shaped magnet permits the use of a larger diameter die rod 30, permitting it to carry in one direction a magnetic flux sufficient to cause a saturation magnetic flux density at the outer perimeter of the toroidal shaped magnetic powder, the magnetic flux can enter cavity 76 in only one direction. This will allow the use of only one solenoid.

Figure 3:
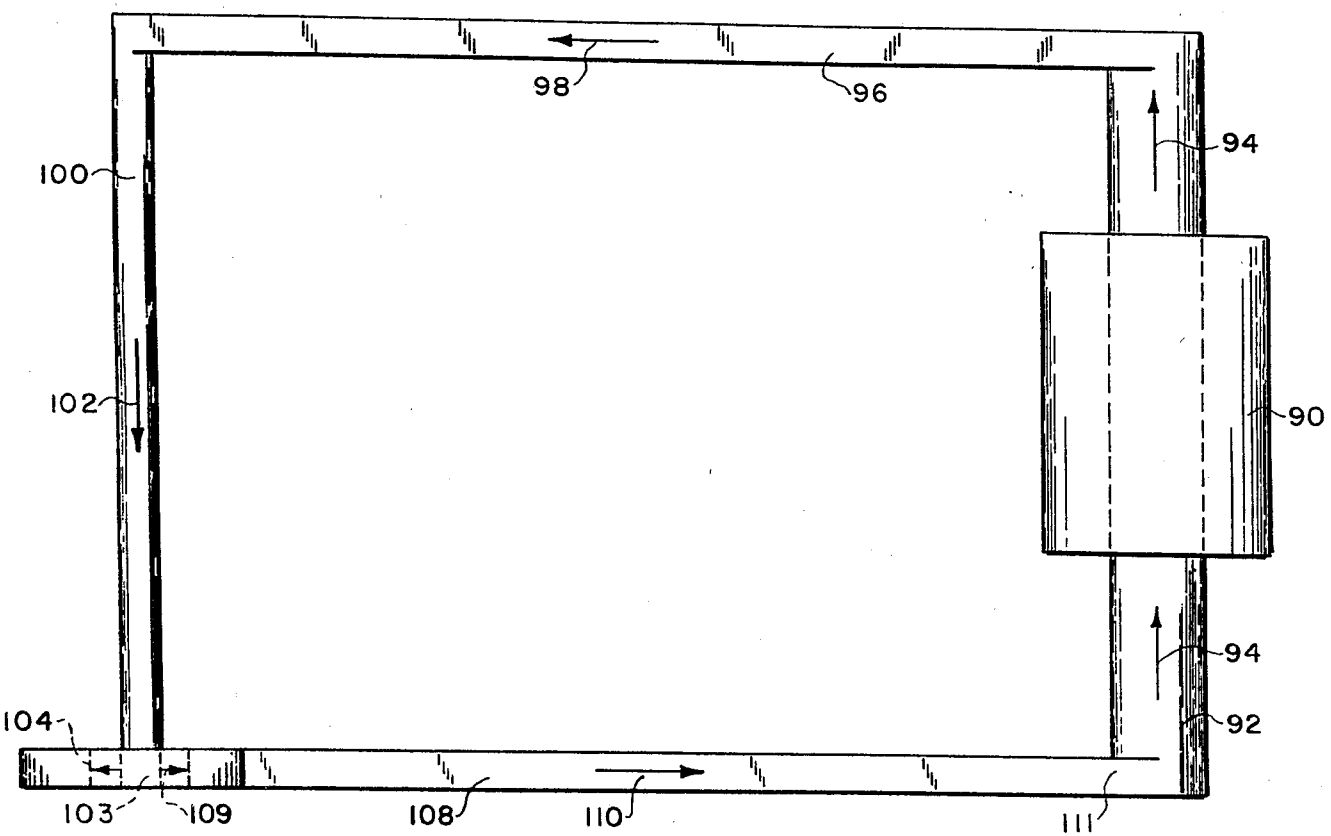
FIG. 3 is a front elevation view of apparatus constructed in accordance with the teachings of the invention which is suitable for pressing and radially-aligning toroidal permanent magnets having a central opening of somewhat larger size.
Figure 4:
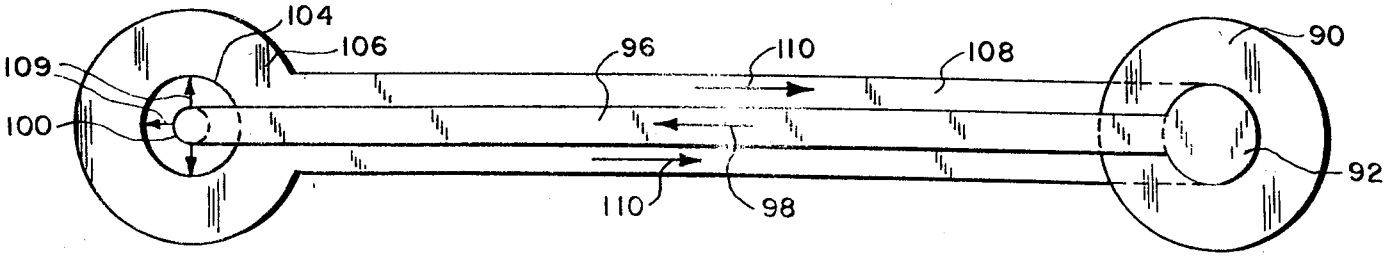
FIG. 4 is a top plan view of the apparatus shown in FIG. 3.

In FIGS. 3 and 4 of the drawings, an alternative embodiment of the invention is shown in which magnetic flux is supplied to the yoke member in only one direction. The punch 32, die bodies 40 and 46, and anvil 52 may take the same form as shown in the embodiment of FIGS. 1 and 2 and have been omitted from FIGS. 3 and 4 for convenience of illustration. A solenoid 90 is disposed about a solenoid rod 92 and, when energized, creates a magnetic flux within die rod 92 having the direction represented by arrows 94. The magnetic flux is carried from rod 92 by an arm 96 in a direction represented by arrow 98 and is supplied to a cylindrical rod, indicated generally as 100. The direction of magnetic flux carried by rod 100 is represented by arrow 102. One end 103 of the rod is concentrically disposed within a cylindrical bore 104 which is formed in an annular-shaped portion 106 on one end of a yoke member, indicated generally as 108. The other end 111 of the yoke member 108 is magnetically coupled to rod 92.

Since the end 103 of rod 100 is concentrically disposed in yoke member bore 104, the flux 102 in rod 100 passes through the annular gap between rod 100 and bore 104 in a radially-disposed pattern 109 and is returned to the rod 92 by the yoke member 108. The direction of flux is shown by the arrow 110 in yoke member 108.

In this embodiment of the invention, magnetic flux is supplied to the yoke member 108 from only a single direction, as contrasted to the bidirectional arrangement of FIGS. 1 and 2, so that the flux density in the cavity defined by the punch, anvil, two die bodies, yoke member 108 and rod end 103 in FIGS. 3 and 4 is substantially less than in the embodiment of FIGS. 1 and 2 assuming, of course, that the same sized yoke members and rods are used in the two embodiments. Accordingly, the embodiment of the invention shown in FIGS. 1 and 2 is preferred for toroidal magnets having relatively small central apertures or openings while the embodiment of FIGS. 3 and 4 may find application for toroidal magnets having larger central apertures.

The term "toroidally-shaped" as used throughout this specification should be considered to refer to a surface generated by the revolution of a circle, rectangle, or a contour of any shape about an axis lying on its plane. This definition should apply in conjunction with any other commonly accepted definition of the term.

It should be understood that the embodiments depicted herein can be combined in different configurations, and that numerous modifications or alterations may be made therein without departing from the spirit and scope of the invention as set forth in the appended claims.

What is claimed is:

1. Apparatus for pressing magnetic material into a substantially toroidal shape and producing a radially-aligned magnetic field therein comprising:

magnetic flux producing means;

magnetic circuit means coupled to said magnetic flux producing means and defining a closed magnetic circuit therewith, said magnetic circuit means having a first portion defining a cavity, and a second portion disposed in said cavity to create a substantially toroidal-shaped cavity through which the flux in said magnetic circuit passes in radially-aligned paths;

means for placing the magnetic material within the toroidal shaped cavity; and means, disposed in said cavity, for compressing the magnetic material therein.

2. Apparatus as in claim 1 wherein:

said magnetic flux producing means comprises serially-connected first and second magnetic flux producing means, said first and second magnetic flux producing means being coupled in opposition to each other to provide magnetic flux in opposing directions;

said magnetic circuit means includes, first magnetic circuit means coupling said first flux producing means to said second portion of said magnetic circuit means to produce magnetic flux therein in a first direction, second magnetic circuit means coupling said second flux producing means to said second portion of said magnetic circuit means to produce flux therein in an opposite direction to said first direction; and said first portion of said magnetic circuit means comprises a third magnetic circuit means coupled between the magnetic circuit junction of said serially-connected first and second magnetic flux producing means and said second portion of said magnetic circuit, so that the flux in said radially-aligned flux path in said toroidally-shaped cavity is supplied by both said first and second magnetic flux producing means.

3. Apparatus as in claim 1 wherein said second portion comprises:

a cylindrical rod extending concentrically through the substantially cylindrical-shaped cavity of said first portion.

4. Apparatus as in claim 3 wherein said compressing means comprises:

a cylindrical punch coaxially disposed and slidably mounted on a section of said rod and having an outer diameter adapted to slidably engage one end aperture of the substantially cylindrical-shaped cavity of said first portion;

a cylindrical anvil coaxially disposed and slidably mounted on another section of said rod and having an outer diameter adapted to slidably engage the other end aperture of the substantially cylindrical-shaped cavity of said first portion; and a means, connected to said punch and said anvil, for applying an axial force thereto.

5. Apparatus as in claim 4 wherein:

said first magnetic flux producing means comprises a first solenoid; and said second magnetic flux producing means comprises a second solenoid.

6. Apparatus for pressing magnetic material into a substantially toroidal shape and producing a radially-aligned magnetic field therein comprising:

a magnetic flux carrying solenoid rod;

a first solenoid positoned over a portion of said solenoid rod;

a second solenoid positioned over another portion of said solenoid rod and having a winding opposite to that of said first solenoid;

a magnetic flux carrying first arm magnetically coupled to an end of said solenoid rod and extending generally perpendicular thereto;

a magnetic flux carrying second arm magnetically coupled to the other end of said solenoid rod and extending generally parallel and opposite to said first arm;

a magnetic flux carrying die rod magnetically coupled and demountably attached between the other ends of said first and second arm opposite said solenoid rod;

a nonmagnetic first die body having a central bore coaxially positioned around a portion of said die rod;

a nonmagnetic second die body having a central bore coaxially positioned around another portion of said die rod;

a magnetic flux carrying yoke member having a bore on one end, the bore being coaxially positioned around said die rod between said first and second die bodies, and the other end of said yoke member being magnetically coupled to said solenoid rod between said first and second solenoids;

a nonmagnetic cylindrical punch having a central bore coaxially slidably mounted on said die rod and having an outside diameter slidably engaging the central bore of said first die body;

a nonmagnetic cylindrical anvil having a central bore coaxially slidably mounted on said die rod and having an outside diameter slidably engaging the central bore of said second die body; and means, attached to said punch and said anvil, for applying on axial force whereby said punch and said anvil are forced axially toward each other compressing the magnetic material.

7. A method of pressing and radially aligning magnetic material into a toroidal shape, which comprises the steps of:

forming the magnetic material in the toroidal shape;

generating a magnetic flux through the axial center of the toroidal shape of magnetic material and then radially through the toroidal shape of magnetic material;

compressing the magnetic material; and terminating said generating of the magnetic flux.

8. A method of pressing and radially aligning magnetic material as recited in claim 7 including the steps of:

producing a second magnetic flux in a direction opposite to said magnetic flux;

carrying said second magnetic flux through the axial center of the toroidal shape of magnetic material in a direction opposite to the direction of said magnetic flux and then radially through the toroidal shape of magnetic material in the same direction as said magnetic flux.

9. Apparatus in claim 2 wherein: said first portion defines a substantially cylindrical-shaped cavity.

* * * * *